US005186610A

United States Patent [19]

Pennington et al.

[11] Patent Number: 5,186,610

[45] Date of Patent: Feb. 16, 1993

[54] BUOYANT PUMP ASSEMBLY

[76] Inventors: M. Steve Pennington; Veronica J. Fowler-Pennington, both of 307 Timberwind Dr., Norman, Okla. 73072

[21] Appl. No.: 648,260

[22] Filed: Jan. 31, 1991

[51] Int. Cl.[5] ..... F04D 15/00

[52] U.S. Cl. ..... 417/61; 417/12; 415/7; 210/242.1

[58] Field of Search ..... 417/61, 12; 415/7; 210/242.1

[56] References Cited

U.S. PATENT DOCUMENTS 3,397,647 8/1968 Daniel ..... 415/7
3,547,553 12/1970 Stanfield ..... 417/61
4,405,458 9/1983 McHugh, Jr. ..... 210/242.1
4,744,729 5/1988 Hasten et al. ..... 417/12
4,789,307 12/1988 Sloan ..... 417/40

*Primary Examiner*—Richard A. Bertsch
*Assistant Examiner*—David W. Scheuermann
*Attorney, Agent, or Firm*—Robert K. Rhea

[57] ABSTRACT

A drilling mud water recovery apparatus for water collecting on drilling mud precipitated out of the mixture includes a buoyant pump assembly free floating on a layer of water above drilling mud. The pump assembly is connected with a source of electrical energy through electrical controls for a predetermined timed operation of the pump and protecting the pump motor against high and low voltages above or below a predetermined value and a current interrupting function in the event of an electrical short.

3 Claims, 2 Drawing Sheets

BUOYANT PUMP ASSEMBLY

BACKGROUND OF THE INVENTION

1. Field of the Invention

This invention relates to water pumps and more particularly to a buoyant body containing a submersible electric pump for skimming water off a drilling mud reserve pit or the like.

Water based drilling mud is commonly used in rotary drilling of oil and gas wells. The water content of such mud is usually 90% or more.

One purpose of the drilling mud is to remove formation cuttings from the well bore.

During the drilling process excess mud accumulates and waste mud is deposited in a reserve pit where the solids precipitate out of the fluid and water collects on the top thereof. In addition to the water, normally in the waste mud, wash water from washing the rig and rain also collects with the mud in the reservoir. On an oil or gas well drilled to a depth of 10,000 feet, the waste mud and water necessary to be disposed of may average 8-12,000 barrels. The usual method of disposal is trucking the mud to an open pit at a disposal site and allowing the mud to settle and the water to dehydrate or by pumping the mud down hole between the production casing and a well bore into a nonproductive formation.

Both disposal methods create an obvious environmental pollution problem.

This invention, in part at least, minimizes the waste mud disposal problem by reusing water collecting on drilling mud when in a reserve pit. Thus, also reducing the quantity of additional fresh water ordinarily purchased for use with the drilling mud in maintaining its viscosity at a desired ratio.

2. Description of the Prior Art

The most pertinent patent is believed to be U.S. Pat. No. 4,789,307 which discloses a box-like housing having its upper portion filled with buoyant foam for supporting the housing. The housing contains a battery powered sump pump in its depending portion. The housing bottom wall is provided with openings for admitting water for pump removal.

This invention is believed to be distinctive over this patent by providing a substantially disc-like buoyant body having a central depending sump pit for supporting a sump pump and removing water entering the pit through its apertured wall.

SUMMARY OF THE INVENTION

A generally disc-like buoyant body is provided with a central depending sump pit and a plurality of downwardly open radial channels projecting outward from a respective plurality of apertures in the pit wall for permitting water entry.

The pit supports a conventional sump pump connected with a source of electrical energy through a control unit. The pump is provided with an exhaust tube for removing water from the sump pit as the body floats on water in a drilling mud reserve pit.

The principal object of this invention is to provide a buoyant pump assembly for reclaiming fresh water collecting on the surface of drilling mud when stored in a pit for reuse in well drilling operations and to minimize environmental pollution by decreasing the quantity of waste drilling mud to be disposed of or recycled.

DESCRIPTION OF THE PREFERRED EMBODIMENTS

Figure 1:
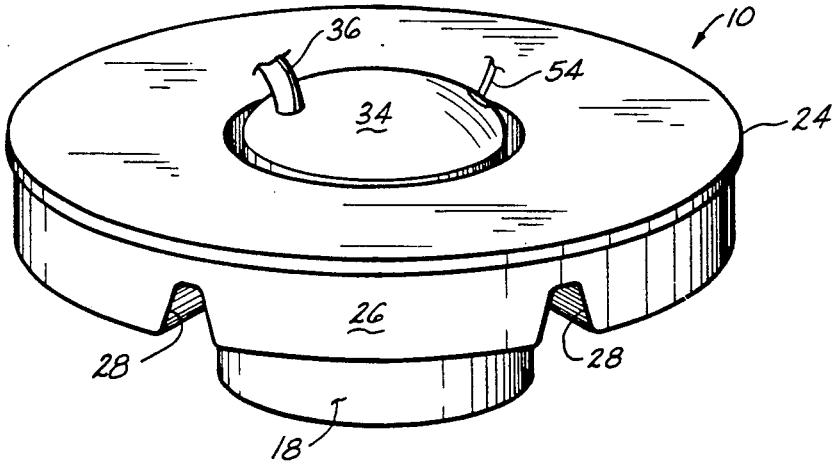
FIG. 1 is a perspective view of the buoyant body and pump.
Figure 2:
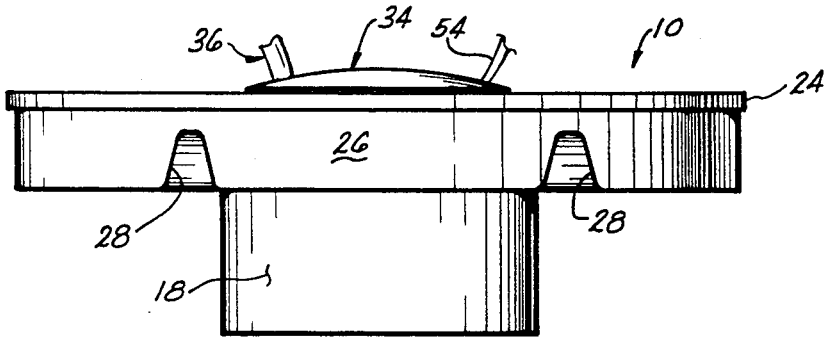
FIG. 2 is a side elevational view.

Like characters of reference designate like parts in those figures of the drawings in which they occur.

In the drawings:

The apparatus principally comprises a buoyant pump assembly 10 and an electrical control unit 12.

The buoyant pump assembly 10 comprises an upwardly open bucket-like container 14 having a flat bottom 16 and an upstanding annular wall 18 forming a well or sump pit 20.

Figure 3:
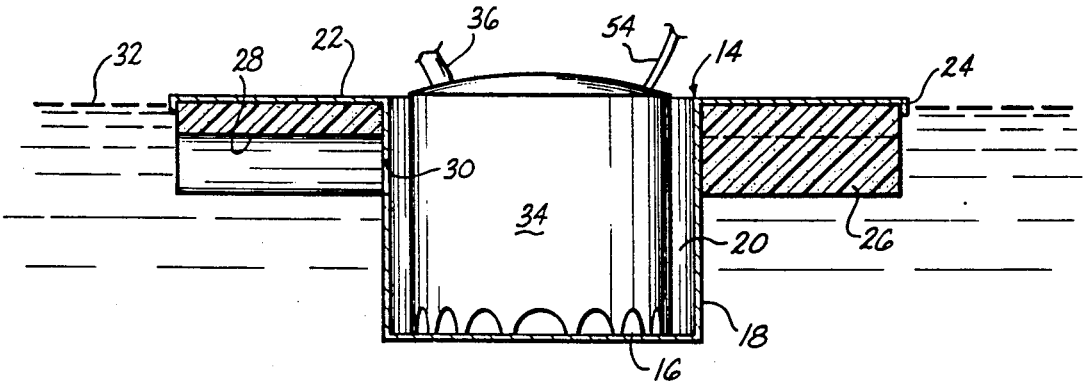
FIG. 3 is a vertical cross sectional view, partially in elevation, taken substantially along the line 3—3 of FIG. 4.
Figure 4:
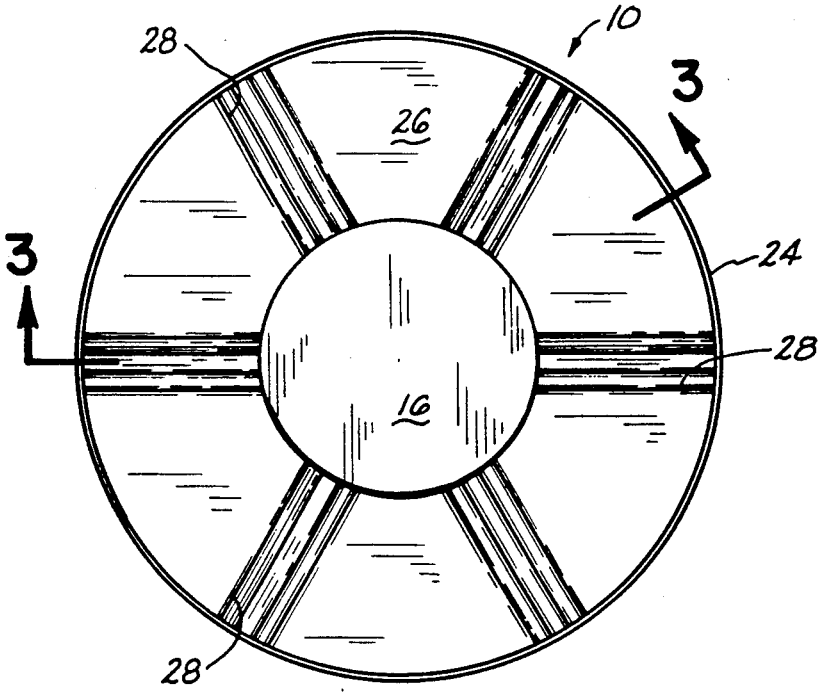
FIG. 4 is a bottom view.
Figure 5:
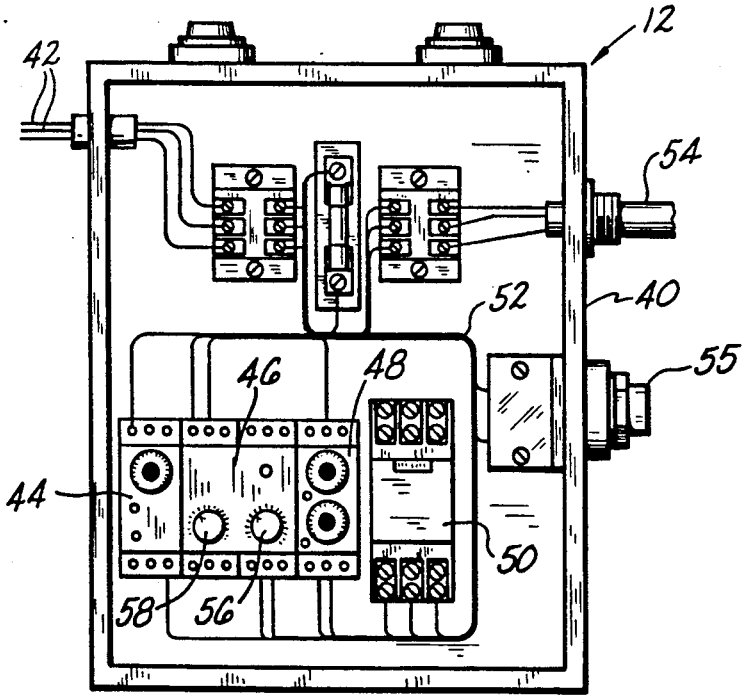
FIG. 5 is an elevational view of the electrical control unit with its housing cover removed for clarity.

The wall 18 is provided with a ring-like horizontal flange 22 at its upper limit having a radial dimension preferably at least two-thirds the diameter of the pit 20 and having its peripheral edge portion turned downwardly a relatively short distance, as at 24, for nesting the upper surface and outer perimeter edge portion of a buoyant plastic foam ring 26, rectangular when viewed in toric cross section (FIG. 3) forming a float in combination with the body 14. The vertical dimension of the foam ring 26 is less than one-half the depth of the well, as viewed in the drawings, to enhance gravity flow of liquid into the pit 20.

The depending portion of the ring 26 is provided with a plurality of radially disposed downwardly open channels 28. The well wall 18 is provided with a like plurality of apertures 30 cooperatively aligned with the respective channel 28 for admitting water into the pit 20 when the device 10 is floating on water 32 contained by a drilling mud reserve pit, not shown.

The sump pit 20 contains a conventional submersible sump pump 34 having its output connected, as by a flexible hose 36, with a water receiving container or reservoir, not shown, remote from the mud pit and body of water 32.

The electrical control unit 12 comprises a junction box housing 40 having terminals connected with a source of electrical energy indicated by the wires 42.

The housing 40 contains a delay timer 44, a high, low circuit protecting unit 46, a pump timer unit 48 and a relay 50 operatively interconnected by wiring 52 and in turn connected by other wiring 54 through on "on-off" switch 55, with the sump pump 34.

Rather than being a float operated sump pump, as is conventional with sump pumps, the timer unit 48 provides a control which operates the pump "on" or "off" from one second to a ten hour duration. The times of operation "on" or "off" being determined in accordance with the volume of water to be removed from the reserve pit and the time lapse necessary for additional water to collect above mud in the pit.

In wild cat well drilling operations the well location is usually remote from a source of industrial electricity and the drilling unit generates electric current necessary for drilling operations. The high-low voltage protector unit 46 performs dual functions. First, it protects the pump from high voltage surges and too low a voltage by current interruption. Secondly, this unit functions as a ground fault indicator, so that a short in the wiring 54, which would be dangerous to equipment or an operator, interrupts the circuit at a predetermined low value of amperage.

OPERATION

In operation, the apparatus is assembled as described hereinabove. The pump flotation unit 10 is manually placed on a body of water 32 on a drilling mud reserve pit.

The pump hose 36 has its free end portion disposed in a suitable receptacle, not shown, for storing water pumped from the reserve pit.

The control box 12 is usually positioned at a selected location at the edge of or remote from the reserve pit.

Assuming the "on-off" control switch 55 is "on" and the timer 48 has been set for the desired period of "on" time and "off" time for the pump 34. The timer "on" control energizes the relay 50 in turn energizing the sump pump 34 for removing water continuously collecting in the sump pit 20 through the float channels 28.

This operation continues until the timer interrupts the current to the pump motor, which as seems obvious, may be manually interrupted by the switch 55 in the event visual observation determines the water has been exhausted on the surface of the precipitated mud.

Obviously the invention is susceptible to changes or alterations without defeating its practicability. Therefore, we do not wish to be confined to the preferred embodiment shown in the drawings and described herein.

We claim:

1. A pumping apparatus for reclaiming water from a drilling mud pit, comprising:

disk-like horizontal buoyant body means having a central annular depending wall having an aperture in its upper end portion for forming a sump pit and further including:

a buoyant ring surrounding the upper end portion of said wall, said ring having a radially disposed downwardly open recess longitudinally aligned with the aperture for admitting water to said sump pit;

sump pump means in said pit for removing water collection therein;

wiring connection a source of electrical energy with said pump;

electrical control mans interposed in said wiring for starting and stopping said pump including:

adjustable timer means for operating said pump at predetermined intervals; and, sensing means responsive to variations in the magnitude of electrical current for controlling the voltage and amperage.

2. A pumping apparatus for reclaiming water from a drilling mud pit, comprising:

a planar disk-like ring having a downturned peripheral flanged edge and having a central annular depending wall for forming a sump pit, said wall having a plurality of circumferentially spaced apertures in its upper end portion;

a buoyant ring underlying said disk-like ring within said downturned flange and surrounding the upper end portion of said wall, said buoyant ring having a like plurality of radially disposed downwardly open recesses longitudinally aligned with the respective aperture for admitting water to said pit;

sump pump means in said pit for removing water collecting therein;

wiring connecting a source of electrical energy with said pump; and, electrical control means interposed in said wiring for starting and stopping said pump.

3. The pumping apparatus according to claim 2 in which said electrical control means includes:

adjustable timer means for operating said pump at predetermined intervals; and, sensing means responsive to variations in the magnitude of electrical current for controlling current voltage and amperage.

* * * * *